US008565453B2

(12) United States Patent
Akino

(10) Patent No.: US 8,565,453 B2
(45) Date of Patent: Oct. 22, 2013

(54) RIBBON MICROPHONE UNIT WITH SYMMETRICAL SIGNAL PATHS

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 234 days.

(21) Appl. No.: 13/087,985

(22) Filed: Apr. 15, 2011

(65) Prior Publication Data

US 2011/0261980 A1 Oct. 27, 2011

(30) Foreign Application Priority Data

Apr. 27, 2010 (JP) ..... 2010-102258

(51) Int. Cl.
*H04R 25/00* (2006.01)

(52) U.S. Cl.
USPC ..... 381/176

(58) Field of Classification Search
USPC ..... 381/176
See application file for complete search history.

(56) References Cited

U.S. PATENT DOCUMENTS 2,226,934 A * 12/1940 Kannenberg ..... 381/176

FOREIGN PATENT DOCUMENTS

| | | |
|---|---|---|
| JP | S47-27831 | 11/1972 |
| JP | S57-39193 | 3/1982 |
| JP | 2000-350284 | 12/2000 |

* cited by examiner

*Primary Examiner* — Brian Ensey
*Assistant Examiner* — Katherine Faley
(74) *Attorney, Agent, or Firm* — Whitham Curtis Christofferson & Cook, PC

(57) ABSTRACT

A ribbon microphone unit includes a pair of magnets generating a magnetic field, a ribbon diaphragm disposed in the magnetic field generated by the magnets, and a circuit substrate provided with signal paths that conduct electrical signals generated by vibration of the ribbon diaphragm to output terminals. The signal paths are symmetrical about the longitudinal central axis of the ribbon diaphragm.

6 Claims, 6 Drawing Sheets

RIBBON MICROPHONE UNIT WITH SYMMETRICAL SIGNAL PATHS

BACKGROUND OF THE INVENTION

1. Field of the Invention

The present invention relates to a ribbon microphone unit including a ribbon-shaped diaphragm (hereinafter referred to as "ribbon diaphragm") and a ribbon microphone including the ribbon microphone unit. Specifically, the present invention relates to a ribbon microphone unit and a ribbon microphone having a structure that can prevent generation of noise affected by an external magnetic field.

2. Related Background Art

A ribbon microphone including a ribbon diaphragm is one of the magnetoelectric microphones that collect sound by electromotive force developed by vibration of a diaphragm. The ribbon microphone, which was avoided for a long time due to low sensitivity, has started to be used by preference to collect sound of voice, traditional Japanese musical instruments, and string instruments because of its soft sound quality without discomfort. The ribbon microphone has recently drawn attention in recording sites.

The ribbon microphone is provided with a ribbon diaphragm which serves as a diaphragm and a conductor in a parallel magnetic field. The ribbon diaphragm vibrates in response to sound waves in the magnetic field, and then generates power as it traverses a magnetic flux. Electrical signals proportional to a vibration speed of the ribbon diaphragm are output from two ends in the length direction of the ribbon diaphragm. The electrical signals depend on the frequency and amplitude of the ribbon diaphragm. The sound waves impinging onto the ribbon diaphragm are thus converted into the corresponding electrical signals. This is the principle of the ribbon microphone.

Such a ribbon microphone has a ribbon microphone unit as shown in FIG. 4, for example. FIG. 4 is a front view illustrating a typical conventional ribbon microphone unit. In FIG. 4, a ribbon microphone unit 101 is composed mainly of a support 102 shaped into a rectangular frame; a pair of magnets 104 mounted on the two respective long sides of the internal surface of the support 102 to generate a magnetic field; and a ribbon diaphragm 103 disposed in the magnetic field generated by the pair of magnets 104. The magnets 104 are permanent magnets and are fixed at a predetermined distance. Furthermore, the magnets 104 are magnetized in the width direction (horizontal direction in FIG. 4). Since the magnets 104 are magnetized in the same direction, a parallel magnetic field is generated between the pair of magnets 104.

Two ends in the length direction of the ribbon diaphragm 103 are fixed by electrodes (not shown in the drawing). The electrodes are in contact with electrode contacts 105 and 106, respectively, to retrieve electrical signals generated from the ribbon diaphragm 103. The electrode contacts 105 and 106 are insulated from the support 102, but are electrically conducted to the ribbon diaphragm 103 through contact with the electrodes provided on the two ends of the ribbon diaphragm 103.

FIGS. 5A to 5C illustrate only the ribbon diaphragm 103 included in the ribbon microphone unit 101 and a substrate 107 to which the ribbon diaphragm 103 is fixed. A side to which the ribbon diaphragm 103 is fixed is illustrated in a front view in FIG. 5A, in a side view in FIG. 5B, and in a rear view in FIG. 5C.

As shown in FIGS. 5A and 5B, the ribbon diaphragm 103 is sandwiched at two ends in the length direction by electrodes 115 and 116 provided on the substrate 107. The two ends are fixed by the electrodes 115 and 116 such that the ribbon diaphragm 103 is held under appropriate tension. The electrodes 115 and 116 are in contact with the electrode contacts 105 and 106, respectively. Thus, electrical signals associated with vibration of the ribbon diaphragm 103 are output through the electrode contacts 105 and 106. The ribbon diaphragm 103 is a conductor strip having a thickness of several microns. Specifically, an aluminum foil is widely used as a material for the ribbon diaphragm 103. Aluminum is suitable for a ribbon diaphragm of a ribbon microphone due to high conductivity and low specific gravity compared with other metal materials.

For use of a thin conductive plate, such as an aluminum foil, the material of the ribbon diaphragm 103 must have a reduced resonant frequency. Thus, the plate is generally corrugated as shown in FIG. 5B. The ribbon diaphragm 103 is corrugated into a bellows in the width direction (bent alternately at constant intervals into a triangular waveform). Such a bellows shape substantially lengthens the ribbon diaphragm 103, thus reducing the resonant frequency.

The ribbon diaphragm 103 described above is lightweight and easy to move and is vulnerable to noise such as human breath and external mechanical vibrations. The ribbon diaphragm 103, however, has a wide frequency range, allowing pickup of a wide range of sound from bass to treble.

FIG. 5C is a typical circuit pattern formed on the rear surface of the substrate 107 included in the ribbon microphone unit. Two signal paths 108 and 109 are provided on the rear surface of the substrate 107. The signal path 108 is integrated with the rear surface of the electrode 115 and surrounds the side surface of the ribbon diaphragm 103 over a half perimeter. Similarly, the signal path 109 is integrated with the rear surface of the electrode 116 and surrounds the other side surface of the ribbon diaphragm 103 over a half perimeter. The two ends of the ribbon diaphragm 103 held by the electrodes 115 and 116 are conductive to the signal paths 108 and 109, respectively.

With the ribbon microphone unit 101, the ribbon diaphragm 103 has the two ends fixed by the electrodes 115 and 116, which are conducted to the circuit pattern forming the signal paths 108 and 109, respectively. Thus, the electrical signals generated from the ribbon diaphragm 103 are retrieved from the electrode contacts 105 and 106 through the signal paths 108 and 109, respectively, and then are output to an amplifier circuit connected to the ribbon microphone unit 101.

The ribbon microphone including the ribbon microphone unit 101 having the structure described above is one of the electrodynamic microphones. The ribbon diaphragm 103 has low impedance, and thus a low output level. The signals output from the ribbon microphone unit 101 are thus boosted by a step-up transformer such that the output impedance is adjusted to an appropriate level prior to output.

FIGS. 6A and 6B illustrate an example of the ribbon microphone unit 101 connected to a step-up transformer 201. FIG. 6A is an example of wire connection of the ribbon microphone unit 101 and the step-up transformer 201; and FIG. 6B is an example of an equivalent circuit of the wire connection illustrated in FIG. 6A.

In FIG. 6A, the electrode 115 (not shown in the drawing) conducted to the signal path 108 is connected to one terminal on the primary side of the step-up transformer 201; while the electrode 116 (not shown in the drawing) conducted to the signal path 109 is connected to the other terminal on the primary side of the step-up transformer 201. Thus, electrical signals generated by the ribbon diaphragm 103 in response to sound waves are input to and boosted at the step-up transformer 201. The electrical signals output from the ribbon diaphragm 103 are boosted and output to the secondary side of the step-up transformer 201. The equivalent circuit of the ribbon microphone unit 101 wired as in FIG. 6A is shown in FIG. 6B. As shown in FIG. 6B, one terminal of the signal path 108 is connected to one terminal of the ribbon diaphragm 103; while the other terminal of the signal path 108 is connected to one terminal on the primary side of the step-up transformer 201. One terminal of the signal path 109 is connected to the other terminal of the ribbon diaphragm 103; while the other terminal of the signal path 109 is connected to the other terminal on the primary side of the step-up transformer 201. In the ribbon microphone unit 101, a closed circuit is thus composed of the ribbon diaphragm 103, the signal path 108, the signal path 109, and the primary side of the step-up transformer 201.

In the closed circuit shown in FIG. 6B, an external magnetic field applied around the ribbon diaphragm 103 may generate electromotive force due to electromagnetic induction in each of the ribbon diaphragm 103, the signal path 108, and the signal path 109. The electromotive forces are integrated and applied to the primary side of the step-up transformer 201. Signals generated by the external magnetic field are thus boosted by and output from the step-up transformer 201. The "signals generated by the external magnetic field" are noise. In other words, the ribbon microphone unit may generate noise affected by an external magnetic field. The external magnetic field is primarily generated by commercial AC power sources and other power sources. Although a power source is required to operate devices for amplifying and adjusting the output of the ribbon microphone (an amplifier and a mixer), such an AC power source (commercial AC power source) around the ribbon microphone generates an external magnetic field, thus generating noise.

An attempt to avoid the problem is to use a microphone case composed of a magnetic material for magnetic shielding. It is difficult, however, to completely shield an external magnetic flux. A mechanism is thus desired to cancel the induction of the external magnetic field around the ribbon diaphragm.

Another type of ribbon microphone includes four ribbon diaphragms so as to retrieve the outputs from the ribbon diaphragms separately or synthetically (refer to Japanese Unexamined Utility Model Application Publication No. S47-27831). Furthermore, a magnetic circuit of a ribbon speaker, although not a ribbon microphone, is proposed in which a magnetic flux is concentrated in a vibration system to improve conversion efficiency so as to reduce distortion of reproduced sound (refer to Japanese Unexamined Utility Model Application Publication S57-39193). In addition, a high-quality high-tone speaker is proposed in which a magnetic force of a magnetic gap is extremely large (refer to Japanese Unexamined Patent Application Publication No. 2000-350284).

None of these patent literatures, however, can prevent the noise generation by the induction of the external magnetic field.

SUMMARY OF THE INVENTION

In view of the circumstances above, an object of the present invention is to provide a ribbon microphone unit including a ribbon diaphragm and a circuit substrate having signal paths that can cancel noise generated by an external magnetic field originated from a commercial AC power source and a ribbon microphone including the ribbon microphone unit.

The present invention relates to a ribbon microphone unit including at least a pair of magnets generating a magnetic field; a ribbon diaphragm disposed in the magnetic field generated by the magnets; and a circuit substrate including signal paths that conduct electrical signals generated by vibration of the ribbon diaphragm. The signal paths are symmetrical about a longitudinal central axis of the ribbon diaphragm.

In the ribbon microphone unit, preferably one of the signal paths is conducted to one terminal of the ribbon diaphragm and is a loop signal path surrounding the periphery of the ribbon diaphragm, and the other signal path is conducted to the other terminal of the ribbon diaphragm and is adjacent to the loop signal path.

Preferably, in the ribbon microphone unit, two ends of the ribbon diaphragm are sandwiched by respective electrodes on one surface of the circuit substrate; and the respective electrodes are individually conducted to the two signal paths provided on the opposite surface of the circuit substrate.

Furthermore, the present invention relates to a ribbon microphone including the ribbon microphone unit.

According to the present invention, the signal paths on the circuit substrate are symmetrical about the ribbon diaphragm. Thus, electrical signals induced in the ribbon diaphragm by an external magnetic field are offset and canceled on the signal paths, thereby preventing noise generation by the external magnetic field.

DESCRIPTION OF THE PREFERRED EMBODIMENTS

Figure 1:
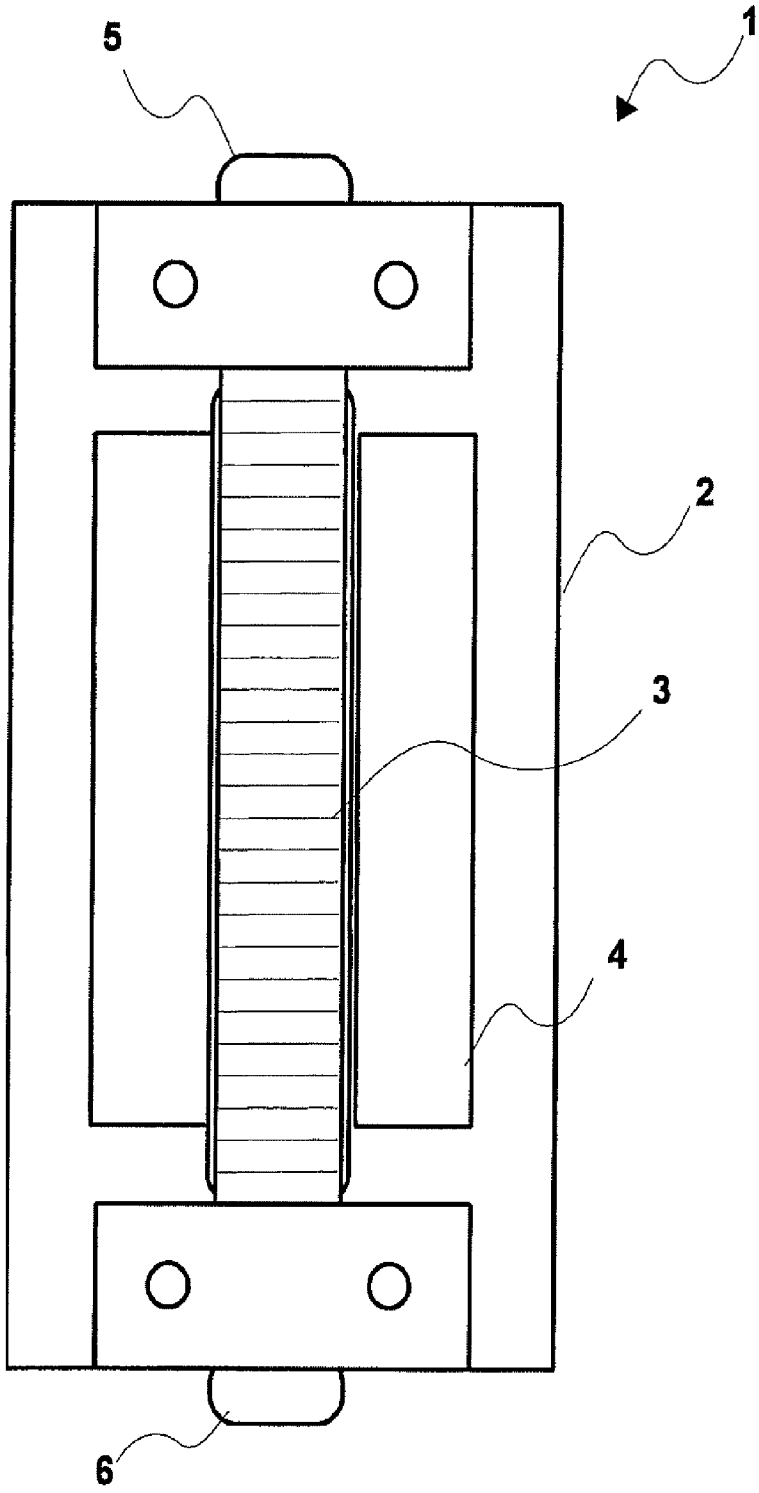
FIG. 1 is a front view of a ribbon microphone unit according to an embodiment of the present invention.

An embodiment of a ribbon microphone unit according to the present invention is explained below in detail with reference to the attached drawings. FIG. 1 is a front view of the ribbon microphone unit according to the embodiment of the present invention. The ribbon microphone unit 1 includes a platy support 2, a pair of magnets 4 mounted on the support 2, and a ribbon diaphragm 3 disposed in a magnetic field generated by the magnets 4. The support 2 has a vertically long window in a longitudinal direction thereof. The magnets 4 are disposed along the two longitudinal sides of the window to generate a uniform magnetic field between the magnets 4. The ribbon diaphragm 3 is disposed such that the direction of vibration crosses the magnetic field generated between the magnets 4. The magnets 4 are permanent magnets and are fixed at a predetermined distance. The magnets 4 are magnetized in the same width direction (the same horizontal direction in FIG. 1). Thus, a parallel magnetic field is generated between the pair of magnets 4.

The ribbon diaphragm 3 is a movable diaphragm formed into a ribbon shape. The ribbon diaphragm 3 can be formed of any conducive and lightweight material. A material meeting such requirements is an aluminum foil, which is included in most conventional ribbon microphones. Thus, a ribbon diaphragm 3 composed of an aluminum foil is explained in the embodiment.

An electrode contact 5 projecting upward from the upper end of the support 2 functions as a first output terminal that outputs audio signals generated in the ribbon diaphragm 3. An electrode contact 6 projecting downward from the lower end of the support 2 functions as a second output terminal that outputs audio signals generated in the ribbon diaphragm 3.

A detailed structure of the ribbon microphone unit 1 according to the embodiment is explained below with reference to FIGS. 2A to 2C, which illustrate the ribbon microphone unit 1 excluding the support 2, the magnets 4, and the electrode contacts 5 and 6 from the ribbon microphone unit 1 in FIG. 1.

Figure 2A:
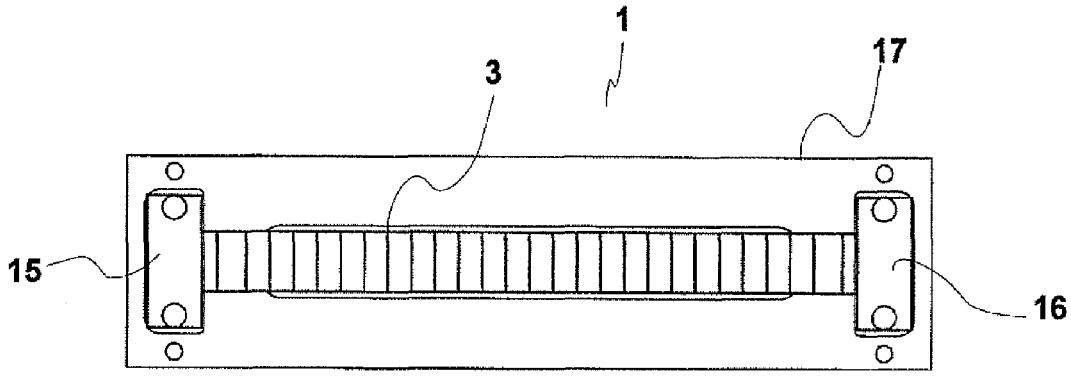
FIG. 2A is a front view of the ribbon microphone unit according to the embodiment of the present invention.
Figure 2B:
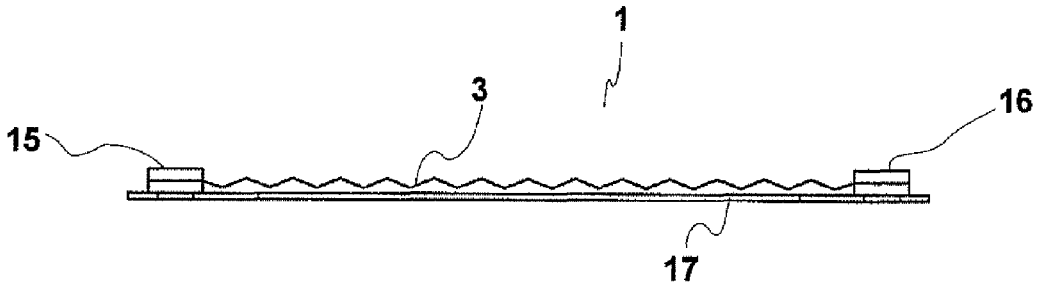
FIG. 2B is a side view of the ribbon microphone unit according to the embodiment of the present invention.

In the ribbon microphone unit 1, the ribbon diaphragm 3 is sandwiched and fixed at two ends thereof by a pair of conductive holding members 15 and a pair of conductive holding members 16, as shown in FIGS. 2A and 2B. The two ends are fixed by the holding members 15 and the holding members 16 such that the ribbon diaphragm 3 is held under appropriate tension. The holding members 15 and the holding members 16 function as electrodes, which are in contact with the electrode contacts 5 and 6, respectively, for conduction.

The ribbon diaphragm 3 sandwiched and supported at the two ends by the holding members 15 and the holding members 16 facilitates mounting and fixing thereof to a substrate 17. Furthermore, the ribbon diaphragm 3 serves as a spacer to ensure its placement within the magnetic field generated by the magnets 4.

For use of a thin conductive plate, such as an aluminum foil, the material of the ribbon diaphragm 3 must have a reduced resonant frequency. Thus, the plate is generally corrugated as shown in FIG. 2B. The ribbon diaphragm 3 is corrugated into a bellows in the width direction (bent alternately at constant intervals into a triangular waveform). Such a bellows shape substantially lengthens the ribbon diaphragm 3, thus reducing the resonant frequency.

Figure 2C:
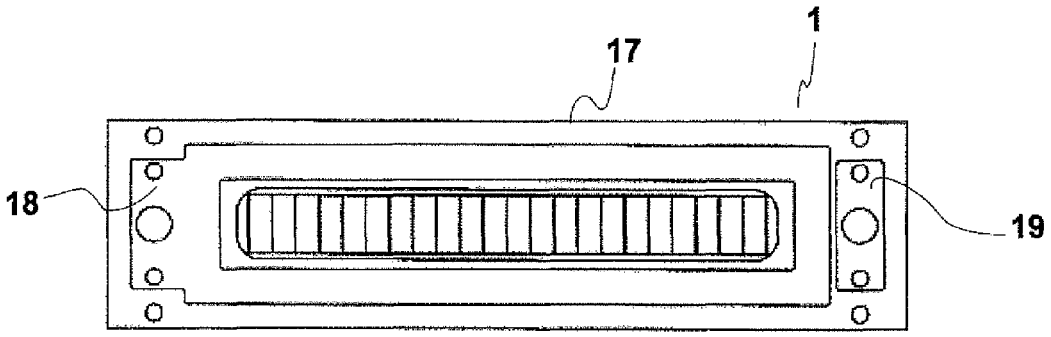
FIG. 2C is a rear view of the ribbon microphone unit according to the embodiment of the present invention.

FIG. 2C is an exemplary circuit pattern formed on the rear surface of the substrate 17 included in the ribbon microphone unit 1 according to the embodiment. Signal paths 18 and 19 forming a circuit pattern are provided on the rear surface of the substrate 17. The signal path 18 is integrated with the rear surface of the electrode 15 and is formed into a loop surrounding the periphery of the ribbon diaphragm 3. The signal path 19 is adjacent to the signal path 18 and integrated with the rear surface of the electrode 16. Thus, the signal paths 18 and 19 are symmetrical about the longitudinal central axis of the ribbon diaphragm 3.

The two ends of the ribbon diaphragm 3 are sandwiched by the electrodes 15 and 16, respectively, on one surface of the substrate 17. The electrode 15 is conducted to the signal path 18 provided on the opposite surface of the substrate 17 in a through-hole structure. The electrode 16 is conducted to the signal path 19 provided on the opposite surface of the substrate 17 in a through-hole structure. Specifically, the electrodes 15 and 16 are separately conducted to the two signal paths 18 and 19, respectively, provided on the opposite surface of the substrate 17.

The electrode contact 5 shown in FIG. 1 is conducted to the electrode 15 while the electrode contact 6 is conducted to the electrode 16. Thus, electrical signals retrieved from the electrode contacts 15 and 16 are input to an amplifier circuit (not shown in the drawing) connected to the ribbon microphone unit 1, and then sound is output in response to the vibration of the ribbon diaphragm 3.

The ribbon microphone unit 1 including the signal paths of the circuit pattern described above is explained further in detail. The ribbon microphone unit 1 according to the embodiment is one of the electrodynamic microphones. The ribbon diaphragm 3 has low impedance, and thus a low output level. The signals retrieved from the electrode contacts 15 and 16 are thus boosted by a step-up transformer such that the output impedance is adjusted to an appropriate level prior to output.

Figure 3A:
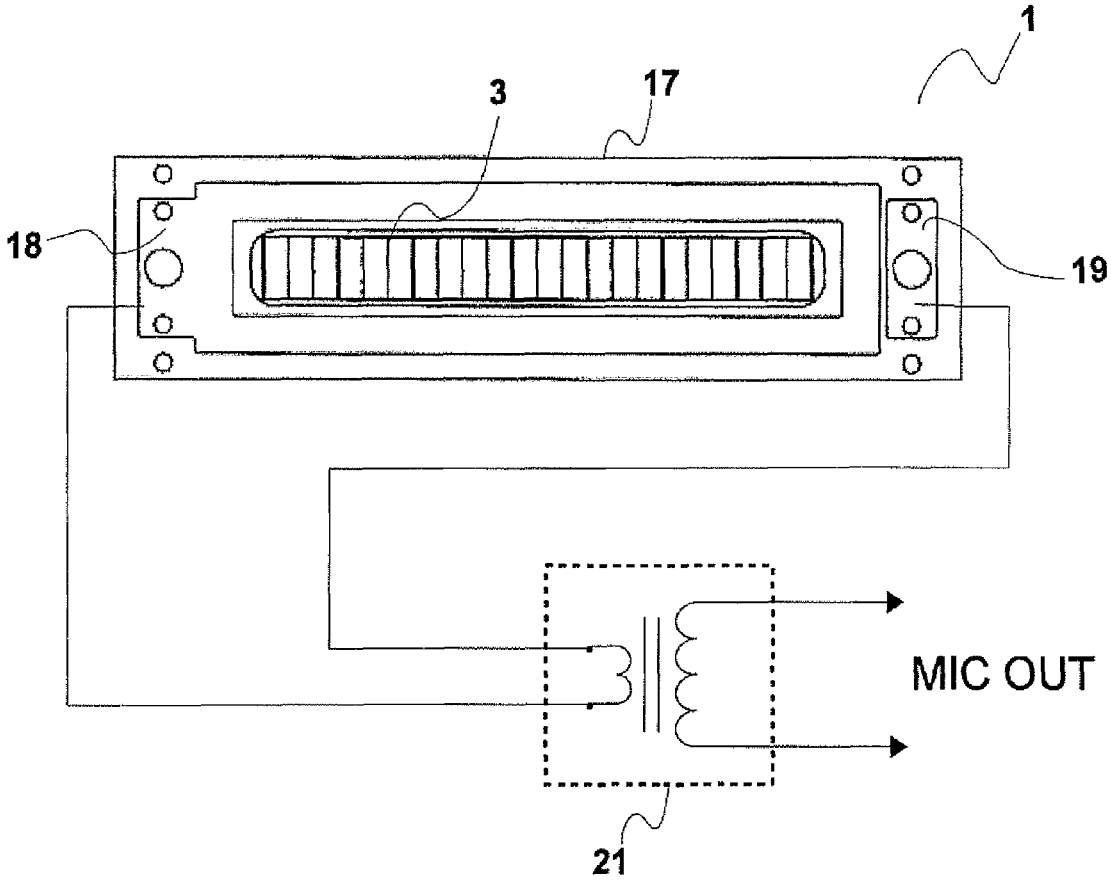
FIG. 3A is a schematic view of wire connection in an exemplary circuit configuration for the ribbon microphone unit according to the embodiment of the present invention.
Figure 3B:
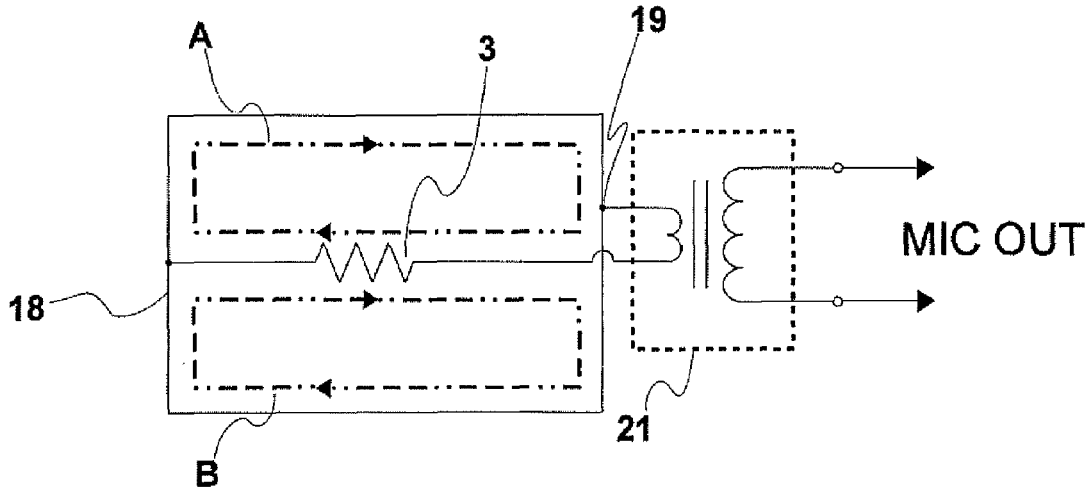
FIG. 3B is a schematic view of an equivalent circuit in the exemplary circuit configuration for the ribbon microphone unit according to the embodiment of the present invention.
Figure 4:
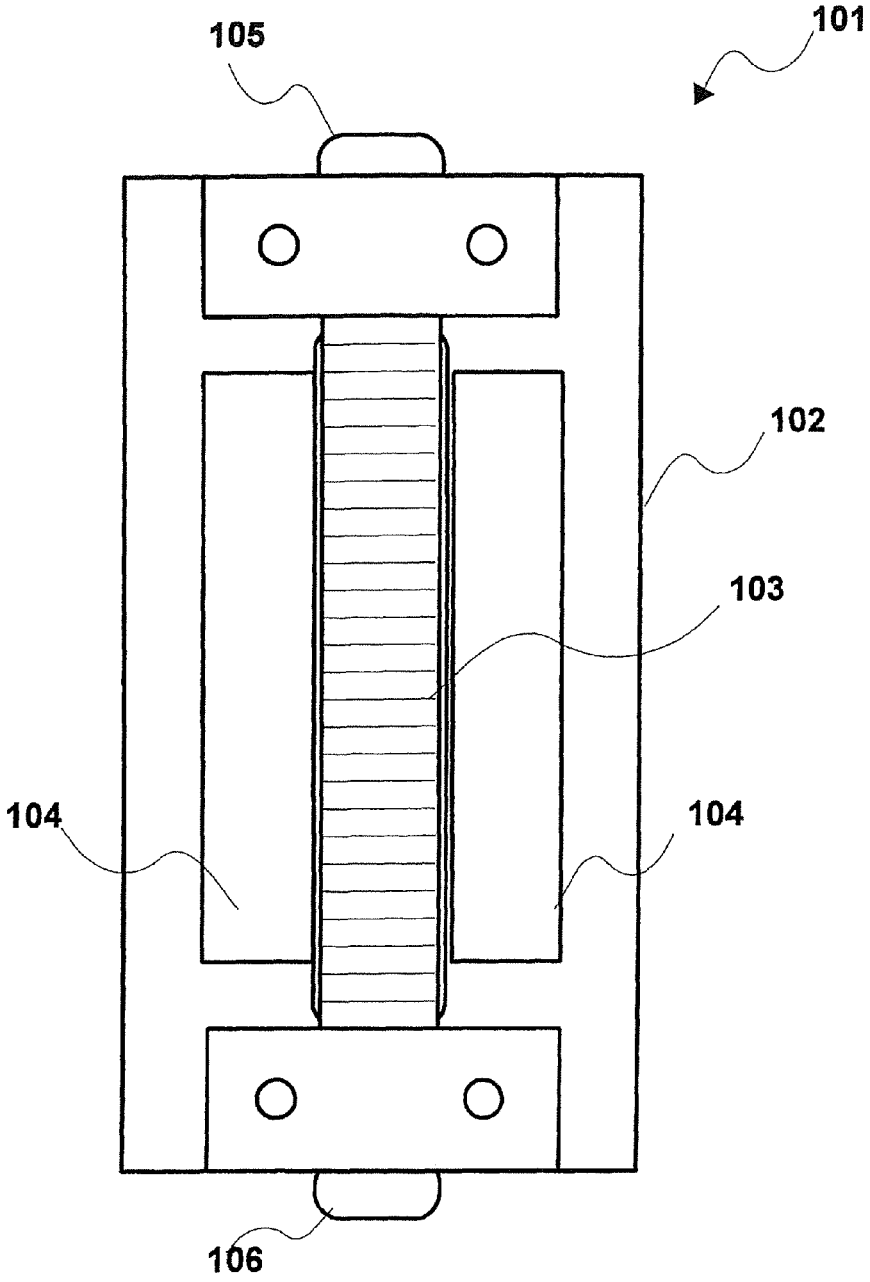
FIG. 4 PRIOR ART
FIG. 4 is a front view of a typical conventional ribbon microphone unit.
Figure 5A:
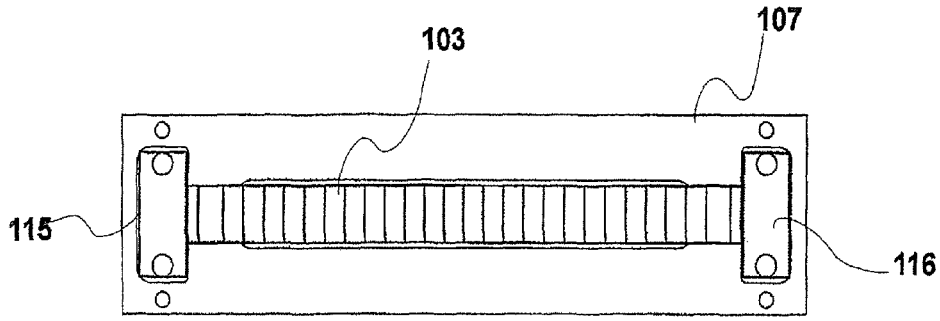
FIG. 5A PRIOR ART
FIG. 5A is a front view of the typical conventional ribbon microphone unit.
Figure 5B:
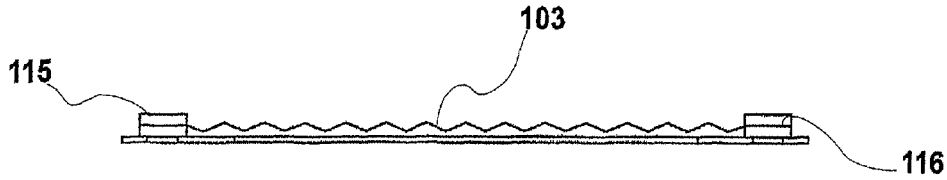
FIG. 5B PRIOR ART
FIG. 5B is a side view of the typical conventional ribbon microphone unit.
Figure 5C:
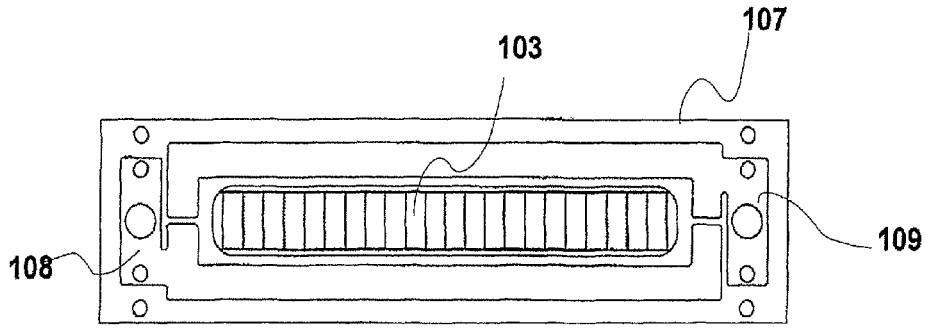
FIG. 5C PRIOR ART
FIG. 5C is a rear view of the typical conventional ribbon microphone unit.
Figure 6A:
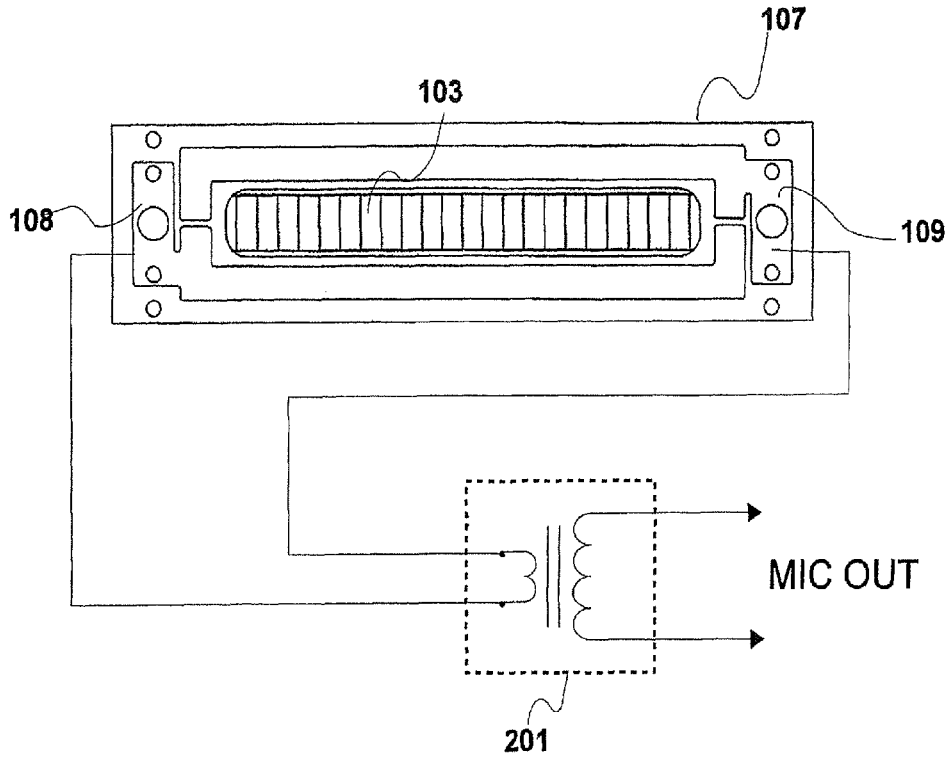
FIG. 6A PRIOR ART
FIG. 6A is a schematic view of wire connection in a typical circuit configuration for the conventional ribbon microphone unit.
Figure 6B:
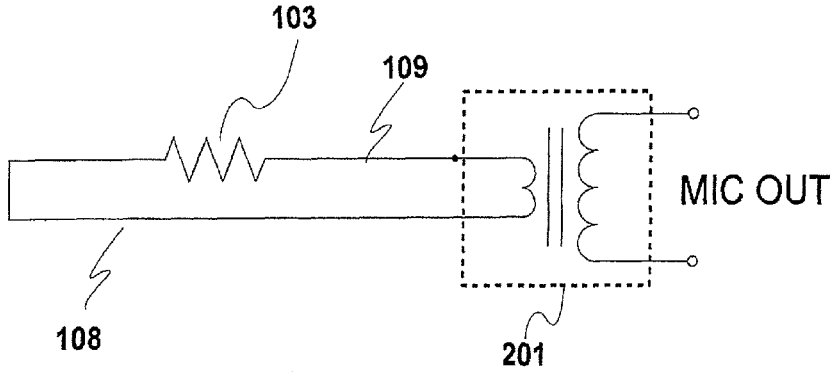
FIG. 6B PRIOR ART
FIG. 6B is a schematic view of an equivalent circuit in the typical circuit configuration for the conventional ribbon microphone unit.

FIGS. 3A and 3B illustrate an example of the ribbon microphone unit 1 connected to a step-up transformer 21. FIG. 3A is an exemplary wire connection; and FIG. 3B is an exemplary equivalent circuit of the wire connection illustrated in FIG. 3A.

With reference to FIG. 3A, the output of the ribbon diaphragm 3 in the ribbon microphone unit 1 is input to the step-up transformer 21 through the signal paths 18 and 19 provided on the rear surface of the substrate 17. The electrical signals generated at the ribbon diaphragm 3 are boosted and output from the secondary side of the step-up transformer 21.

As shown in the equivalent circuit of FIG. 3B, one terminal of the ribbon diaphragm 3 is conducted to the signal path 18 and the other terminal is conducted to one terminal on the primary side of the step-up transformer 21. The signal path 18 is conducted to both the signal path 19 and the other terminal on the primary side of the transformer 21. Specifically, one terminal of the ribbon diaphragm 3 is conducted to one terminal on the primary side of the step-up transformer 21 without through the signal paths 18 and 19, while the other terminal of the ribbon diaphragm 3 is conducted to the other terminal on the primary side of the step-up transformer 21 through the signal paths 18 and 19.

Unique effects of the ribbon microphone unit 1 according to the embodiment are explained with reference to the equivalent circuit shown in FIG. 3B. Signals generated by the action of an external magnetic field exerted on the ribbon diaphragm 3 flow through the signal path 18 as shown by loops A and B. Then, the signal in the loop A flows in a direction opposite to that of the signal flowing in the loop B in the ribbon diaphragm 3. The signals are thus cancelled by each other and offset.

According to the ribbon microphone unit 1 of the embodiment, the signal paths are symmetrical around the longitudinal centerline of the ribbon diaphragm 3; the signal path 18 is formed into a loop to surround the periphery of the ribbon diaphragm 3; and the signal path 19 is provided adjacent to the signal path 18. Thereby, even if induced electromotive force is generated in the ribbon diaphragm 3 by an external magnetic field affected by a commercial AC power source, signals generated by the electromotive force are canceled out on the signal paths and not output to the secondary terminals of the step-up transformer 21. Thereby, the signals (noise) generated by induction can be prevented from being output.

The ribbon microphone unit 1 configured as above may be placed in a metal mesh that receives sound waves and protects internal components, or incorporated into a microphone case provided with a head case composed of a punched metal. The resulting ribbon microphone does not generate noise due to induction of an external magnetic field.

What is claimed is:

1. A ribbon microphone unit comprising:

a support having a window in a longitudinal direction thereof;

a pair of magnets mounted along the longitudinal sides of the window generating a magnetic field between the pair of magnets;

a ribbon diaphragm configured to vibrate in a direction, the ribbon diaphragm is disposed such that the direction of vibration of the ribbon diaphragm crosses the magnetic field generated by the pair of magnets; and a circuit substrate comprising signal paths that conduct electrical signals generated by vibration of the ribbon diaphragm to output terminals, wherein the signal paths are symmetrical about a longitudinal central axis of the ribbon diaphragm, and wherein a first signal path of the signal paths is conducted to a first terminal of the ribbon diaphragm and the first signal path is a loop signal surrounding the entire periphery of the ribbon diaphragm.

2. The ribbon microphone unit according to claim 1, wherein a second signal path of the signal paths is conducted to a second terminal of the ribbon diaphragm and the second signal path is adjacent to the loop signal of the first signal path.

3. The ribbon microphone unit according to claim 1, wherein two ends of the ribbon diaphragm are sandwiched by respective electrodes on one surface of the circuit substrate, and wherein the respective electrodes are individually conducted to the signal paths provided on the opposite surface of the circuit substrate.

4. The ribbon microphone unit according to claim 1, wherein the ribbon microphone unit is comprised within a ribbon microphone.

5. The ribbon microphone unit according to claim 2, wherein the ribbon microphone unit is comprised within a ribbon microphone.

6. The ribbon microphone unit according to claim 3, wherein the ribbon microphone unit is comprised within a ribbon microphone.

* * * * *